US006515633B2

(12) United States Patent
Ippolito

(10) Patent No.: US 6,515,633 B2
(45) Date of Patent: Feb. 4, 2003

(54) RADIO FREQUENCY ISOLATION CARD

(75) Inventor: Joseph R. Ippolito, Flower Mound, TX (US)

(73) Assignee: EMS Technologies, Inc., Norcross, GA (US)

( * ) Notice: Subject to any disclaimer, the term of this patent is extended or adjusted under 35 U.S.C. 154(b) by 0 days.

(21) Appl. No.: 09/999,264

(22) Filed: Nov. 15, 2001

(65) Prior Publication Data

US 2002/0101388 A1 Aug. 1, 2002

Related U.S. Application Data

(60) Provisional application No. 60/249,531, filed on Nov. 17, 2000.

(51) Int. Cl.[7] ..... H01Q 9/28
(52) U.S. Cl. ..... 343/797; 343/795
(58) Field of Search ..... 343/797, 793, 343/817; 455/126, 115

(56) References Cited

U.S. PATENT DOCUMENTS 5,574,994 A * 11/1996 Huang et al. ..... 455/126
5,952,983 A 9/1999 Dearnley et al. ..... 343/817
6,034,649 A 3/2000 Wilson et al. ..... 343/795
6,067,053 A 5/2000 Runyon et al. ..... 343/797
6,069,590 A 5/2000 Thompson, Jr. et al. .... 343/795

* cited by examiner

*Primary Examiner*—Don Wong
*Assistant Examiner*—James Clinger
(74) *Attorney, Agent, or Firm*—King & Spalding

(57) ABSTRACT

One or more feedback elements generate a feedback signal in response to a transmitted signal outputted by each radiator of the antenna system. This feedback signal is received by each radiator, also described as a radiating element, and combined with any leakage signal present at the port of the antenna. Because the feedback signal and the leakage signal are set to the same frequency and are approximately 180 degrees out of phase, this signal summing operation serves to cancel both signals at the output port, thereby improving the port-to-port isolation characteristic of the antenna. Each feedback element can include a photo-etched planar metal strip supported by a planar dielectric card made from printed circuit board material. Such feedback elements can provide a high degree of repeatability and reliability in that the manufacturing of such feedback elements can be precisely controlled.

32 Claims, 6 Drawing Sheets

RADIO FREQUENCY ISOLATION CARD

STATEMENT REGARDING RELATED APPLICATIONS

The present application claims priority to provisional application entitled, "Radio Frequency Isolation Card," filed on Nov. 17, 2000 and assigned U.S. Application Serial No. 60/249,531.

FIELD OF INVENTION

This invention relates to antennas for communicating electromagnetic signals and, more particularly, to improving sensitivity of a dual polarized antenna by increasing the isolation characteristic of the antenna.

BACKGROUND OF THE INVENTION

Many types of antennas are in wide use today throughout the communications industry. The antenna has become an especially critical component for an effective wireless communication system due to recent technology advancements in areas such as Personal Communications Services (PCS) and cellular mobile radiotelephone (CMR) service. One antenna type that has advantageous features for use in the cellular telecommunications industry today is the dual polarized antenna which uses a dipole radiator having two radiating sub-elements that are polarity specific to transmit and receive signals at two different polarizations. This type antenna is becoming more prevalent in the wireless communications industry due to the polarization diversity properties that are inherent in the antenna that are used to increase the antenna's capacity and to mitigate the deleterious effects of fading and cancellation that often result from today's complex propagation environments.

Dual polarized antennas are usually designed in the form of an array antenna and have a distribution network associated with each of the two sub-elements of the dipole. A dual polarized antenna is characterized by having two antenna connection terminals or ports for communicating signals to the antenna that are to be transmitted, and for outputting signals from the antenna that have been received. Thus the connection ports serve as both input ports and as output ports at any time, or concurrently, depending on the antenna's transmit or receive mode of operation.

An undesirable leakage signal can appear at one of these ports as a result of a signal present at the opposite port and part of that signal being electrically coupled, undesirably so, to the opposing port. A leakage signal can also be produced by self-induced coupling when a signal propagates through a power divider and feed network.

The measuring of leakage signals is illustrated in the conventional art of FIG. 1. A main transmission signal a1 can be inputted at port 35. This transmission signal a1 is propagated by the antenna elements 11 coupled to port 35 when these antenna elements 11 are operating in a transmit mode. An undesirable leakage signal b1 can be measured at port 35 as a result of the transmission signal a1 exciting portions of the feed network such as distribution network 15.

In another example, the undesirable leakage signal b1 can be measured at port 35 when a transmission signal a2 is inputted at port 40. The transmission signal a2 can excite portions of the feed network such as distribution network 17 which in turn, can excite antenna elements 11, 12 or distribution network 15 or both. It is noted that other leakage signals (not shown) may be measured at port 40 which are caused by transmission signal a2 itself or signals inputted at port 35.

A dual polarized antenna's performance in terms of it transmitting the inputted signal with low antenna loss of the signal, or of it receiving a signal and have low antenna loss at the antenna's output received signal, can be measured in large part by the signals' electrical isolation between the antenna's two connection ports, i.e., the port-to-port isolation at the connectors or the minimizing of the leakage signal b1. Dual polarized antennas can also have radiation isolations defined in the far-field of the antenna which differ from port-to-port isolations defined at the antenna connectors. The focus of this invention is not on far-field isolation, but rather with port-to-port isolations at connector terminals of a dual polarized antenna.

While a dual polarized antenna can be formed using a single radiating element, the more common structure is an antenna having an array of dual polarized radiating elements 10. In practice, both the transmit and receive functions often occur simultaneously and the transmit and received signals may also be at the same frequency. So there can be a significant amount of electrical wave activity taking place at the antenna connectors, or ports, sometimes also referred to as signal summing points.

The significant amount of electrical wave activity during simultaneous transmission and reception of RF signals can be explained as follows. Poor receive sensitivity, and poor radiated output, often results due to degraded internal antenna loss when part of one of the signals at one input port (port one) leaks or is otherwise coupled as a leakage signal to the other port (port two). Such leakage or undesired coupling of a signal from one port to the other adversely combines with the signal at the other port to diminish the strength of both signals and hence reduce the effectiveness of the antenna. When port-to-port isolation is minimal, i.e., leakage is maximum, the antenna system will perform poorly in the receive mode in that the reception of incoming signals will be limited only to the strongest incoming signals and lack the sensitivity to pick up faint signals due to the presence of leakage signals interfering with the weaker desired signals. In the transmit mode, the antenna performs poorly due to leakage signals detracting from the strength of the radiated signals.

Dual polarized antenna system performance is often dictated by the isolation characteristic of the system and the minimizing or elimination of leakage signals.

Conventional Isolation Techniques

One known technique for minimizing this leakage signal problem is by incorporating proper impedance matching within the distribution networks of the two respective signals. Impedance mismatch can cause leakage signals to occur and degrade the port-to-port isolation if (1) a cross-coupling mechanism is present within the distribution network or in the radiating elements, or if (2) reflecting features are present beyond the radiating elements. Impedance matching minimizes the amount of impedance mismatch that a signal experiences when passing through a distribution network, thereby increasing the port-to-port isolation.

In general, when impedance mismatches are present, part of a signal is reflected back and not passed through the area of impedance mismatch. In a dual polarized antenna system, the reflected signal can result in a leakage signal at the opposite port or the same port and it can cause a significant degradation in the overall isolation characteristic and performance of the antenna system. While impedance matching helps to increase port-to-port isolation, it falls short of achieving the high degree of isolation that is now required in the wireless communications industry.

Another technique for increasing the isolation characteristic is to space the individual radiating elements of the array sufficiently apart. However, the physical area and dimensional constraints placed on the antenna designs of today for use in cellular base station towers generally render the physical separation technique impractical in all but a few instances.

Another technique for improving an antenna's isolation characteristic is to place a physical wall between each of the radiating elements. Still another is to modify the ground plane 30 of the antenna system so that the ground plane 30 associated with each port is separated by either a physical space or a non-conductive obstruction that serves to alleviate possible leakage between the two signals otherwise caused by coupling due to the two ports sharing a common ground plane 30. These techniques can help in increments, but do not solve the magnitude of the signal leakage problem.

Still another conventional technique for improving the isolation characteristic of an antenna is to use a feedback element to provide a feedback signal to pairs of radiators in the antenna array. The feedback element can be in the form of a conductive strip placed on top of a foam bar positioned between radiators. While the conductors, according to this technique, can increase the isolation characteristic, the foam bars that support the conductive strips have mechanical properties that are not conducive to the operating environment of the antenna. For example, the foam bars are typically made of non-conducting, polyethylene foam or plastic. Such materials are usually bulky and are difficult to accurately position between antenna elements.

Additionally, these support blocks have coefficients of thermal expansion that are typically not conducive to extreme temperature fluctuations in the outside environment in which the antenna functions, and they readily expand and contract depending on temperature and humidity. In addition to the problems with thermal expansion, the support blocks are also not conducive for rapid and precise manufacturing. Furthermore, these types of support blocks do not provide for accurate placement of the conductive strips or feedback elements on the distribution network board.

Another problem with this conventional type feedback element is that the element is typically "floating" above its respective ground plane. That is, it is not connected to the ground plane or "grounded". Such an ungrounded feedback system is susceptible to electrostatic charging. The electrostatic charging of these type conductive elements may attract lightning or currents that are formed from lightning.

Consequently, there is a need in the art for a method and system that facilitates the design of a dual polarized antenna system with a high degree of isolation between two respective antenna connection ports that more thoroughly cancels out any port-to-port leakage signals and at the same time, is conducive to high speed manufacturing and a high degree of accurate repeatability. There is also a need in the art for an antenna isolation method and system that can withstand extreme operating environments as a cellular base station antenna is subjected to, and one that is also designed to eliminate any potential problems that are a result from lightning or further leakage from electric charge build-up.

SUMMARY OF THE PRESENT INVENTION

The present invention is useful for improving the performance of an antenna by increasing the port-to-port isolation characteristic of the antenna as measured at the port connectors. In general, the present invention achieves this improvement in sensitivity by using a feedback system comprising one or more feedback elements for generating a feedback signal in response to a transmitted signal output by each radiator of the dual polarized antenna. This feedback signal is received by each radiator, also described as a radiating element, and combined with any leakage signal present at the output port of the antenna. Because the feedback signal and the leakage signal are set to the same frequency and are approximately 180 degrees out of phase, this signal summing operation serves to cancel both signals at the output port, thereby improving the port-to-port isolation characteristic of the antenna.

Each feedback element can comprise a photo-etched metal strip supported by a dielectric card made from printed circuit board material. Such feedback elements can provide a high degree of repeatability and reliability in that the manufacturing of such feedback elements can be precisely controlled. For example, the size, shape, and location of the feedback elements on the dielectric supports can be manufactured by using photo etching and milling processes. Such feedback elements are conducive for high volume production environments while maintaining high quality standards. The manufacturing processes for such feedback elements provide the advantage of small tolerances.

Another important feature of the present invention is the high degree of control over the material properties of the feedback element support structure. Each feedback element support structure is typically an insulative material that has electrical and mechanical properties that are conducive to extreme operating environments of antenna arrays. For example, such feedback element support structures can be selected to provide appropriate dielectric constants (relative permeability), lost tangent (conductivity), and coefficient of thermal expansion in order to optimize the isolation between respective antenna elements in an antenna array.

The characteristics of the feedback signal, including amplitude and phase, can be adjusted by varying the position of the feedback element relative to the radiating element thereby affecting the amount of coupling therebetween and, hence, the amount of port-to-port isolation. The feedback signal can be further adjusted by placing additional feedback elements into the dual polarized antenna system until a specific amount of feedback coupling is produced so to enable the cancellation of any leakage signals passing from port 1 to port 2.

For yet another aspect of the present invention, the feedback elements can comprise etched metal strips disposed upon a planar dielectric support and further comprising grounding elements connecting the etched metal strips to the network ground plane of an antenna array. In one exemplary embodiment, the ground element can comprise a meander line that connects the respective etched metal strip to the ground plan of a beam forming the network. In another exemplary embodiment, the grounding element can comprise the rectilinear etched metal strip of an appropriate width.

It is further noted that the feedback elements may be positioned in a variety of configurations with equal success, such as non-uniform feedback element spacing (non-symmetrical patterns), and tilted feedback elements (introducing a rotational angle). It is further noted that the conductive element may be in varying forms or shapes, for example, the elements may be in the form of strips as well as circular patches.

In one exemplary embodiment, the feedback elements can be combined with dual polarized antenna radiators. In such an exemplary embodiment, the feedback elements may improve the isolation characteristic of signals between two different polarizations.

In an alternate exemplary embodiment, the feedback elements can be combined with multiple band radiating antenna elements. In this way, signals between different operating frequencies can be isolated from one another.

In view of the foregoing, it will be readily appreciated that the present invention provides for the design and tuning method of a dual polarized antenna system or a multiple band antenna system having a high port-to-port isolation characteristic thereby overcoming the sensitivity problems associated with prior antenna designs. Other features and advantages of the present invention will become apparent upon reading the following specification, when taken in conjunction with the drawings and the appended claims.

DETAILED DESCRIPTION OF EXEMPLARY EMBODIMENTS

The isolation card of the present invention can solve the aforementioned problems of leakage signals in, especially, a dual polarized antenna and is useful for enhancing antenna performance for wireless communication applications, such as base station cellular telephone service.

Figure 1:
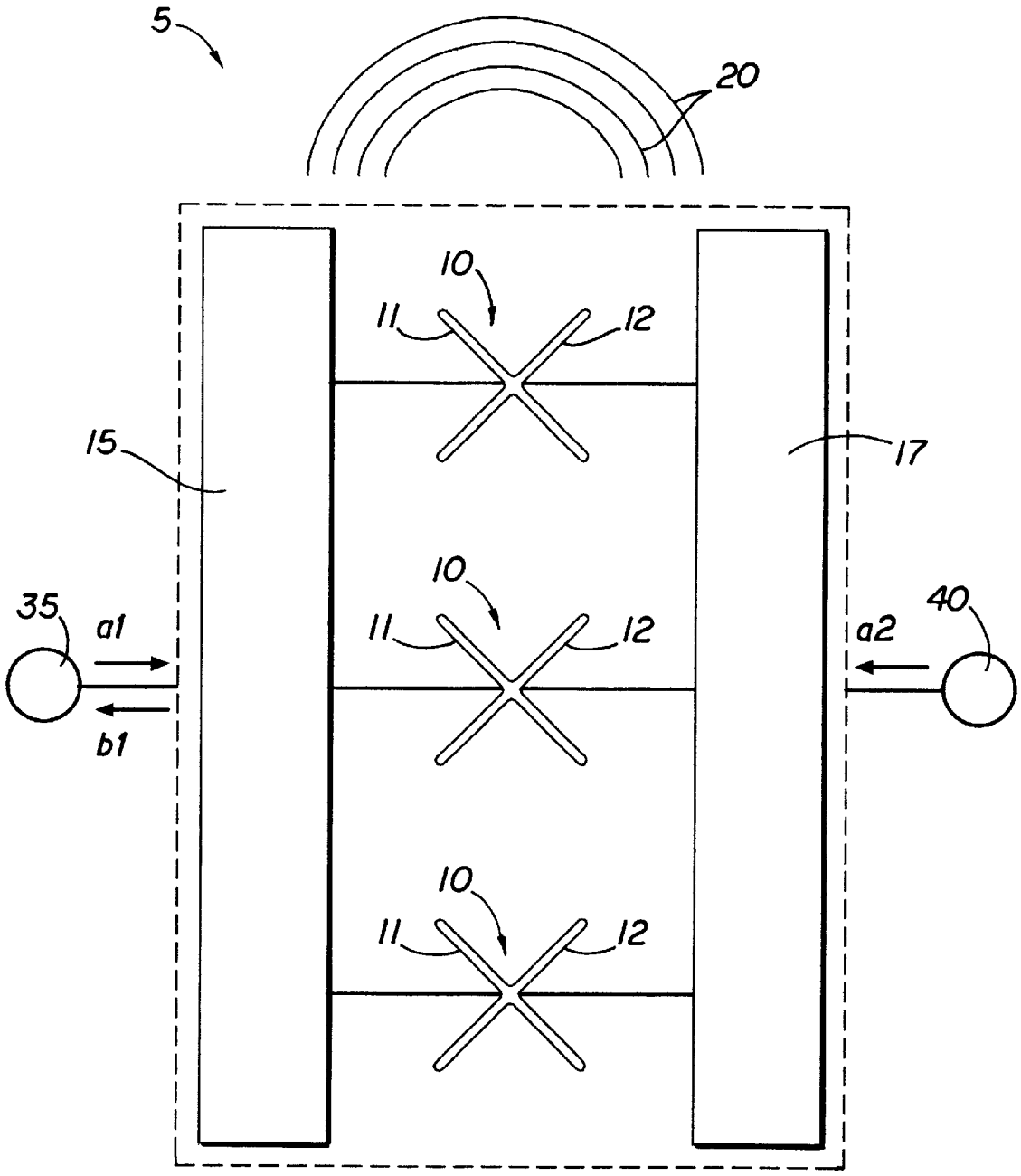
CONVENTIONAL ART FIG.1
FIG. 1 is a block diagram illustrating some of the core components of a conventional dual polarized array antenna, showing the radiator sub-elements, the feed networks, the two connector ports of the antenna system, and signals depicted at both ports.

Turning now to the drawings, in which like reference numerals refer to like elements, FIG. 1 is a diagram that illustrates the basic components of a conventional dual polarized antenna 5. Input/output ports 35 and 40 are the connection ports, or antenna terminals, for inputting and/or receiving signals 20. Each port is connected to its respective distribution network 15, 17 that communicates the signal to one of the two differently polarized sub-elements 11 and 12 in a dual polarized radiator of the antenna. In one exemplary embodiment, the dual polarized radiator comprises a crossed dipole 10. Signals of ports 35 and 40 communicate with a four-element array made of dipole radiator elements 10, although it is understood that there can be any number of radiators making up the antenna array.

Basic to antenna operation is the principal of reciprocity. An antenna operates with reciprocity in that the antenna can be used to either transmit or receive signals, to transmit and receive signals at the same time, and to even transmit and receive signals concurrently at the same frequency. It is understood, therefore, that the invention described is applicable to an antenna operating in either a transmit or receive mode or, as is more normally the case at a cellular antenna base station, operating in both modes simultaneously. The invention operates basically the same way regardless of whether the antenna is transmitting or receiving dual polarized signals at its radiating elements 10.

For simplicity in the description that follows, the antenna system is described generally as operating in a transmit mode. The isolation card 45 of the invention, like the dual polarized antenna of one exemplary embodiment, operates basically the same way regardless of whether the antenna is transmitting or receiving dual polarized signals at its radiating elements 10. The depiction of FIG. 1 thus also shows the overall antenna as transmitting or receiving signals 20.

Also for the purpose of illustrating the present invention, the preferred embodiment is described in terms of its application to an antenna having dual polarized, dipole radiating elements 10, with it understood that use of the invention is not limited to this type of antenna.

Figure 2:
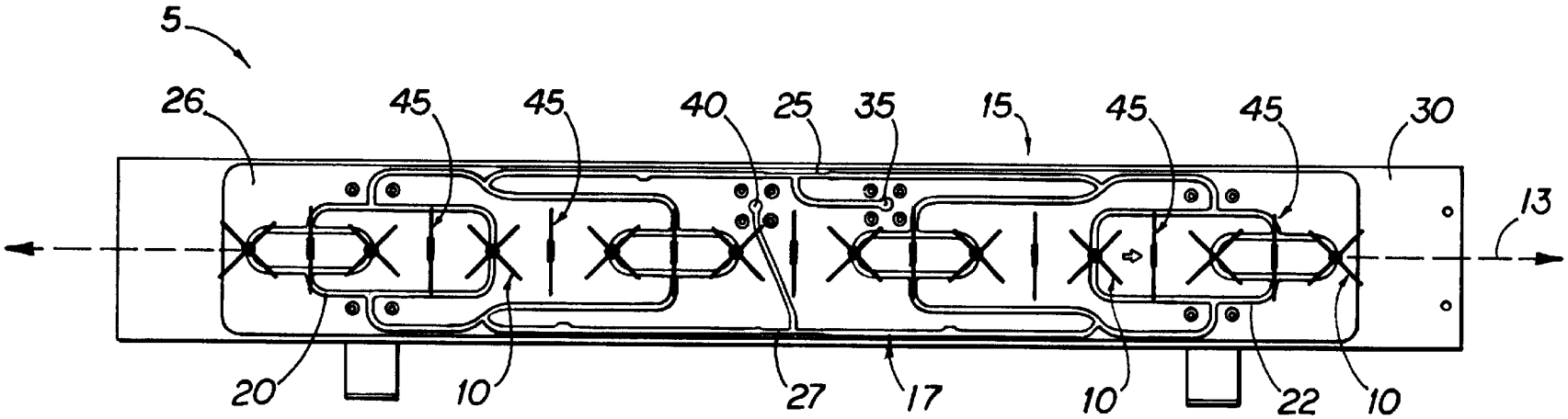
FIG. 2 is an illustration showing an elevational view of the construction of an exemplary embodiment of the present invention, showing the isolation card with its feedback elements.

FIG. 2 is an illustration showing an elevational view of one exemplary embodiment depicting the isolation cards 45 of the invention installed in a dual polarized antenna 5 formed by ten dipole radiator elements 10 in a single column array. The isolation cards 45 are positioned along a vertical plane of the antenna as viewed normal to the longitudinal plane of the antenna. The antenna 5 shown is for communicating electromagnetic signals with high frequency spectrums associated with conventional wireless communication systems.

The antenna 5, which can transmit and receive electromagnetic signals, can comprise radiating elements 10, a ground plane 30, and distribution feed networks 15, 17 associated with each of the respective sub-elements 11, 12 of the radiating elements 10. The antenna 5 further comprises a printed circuit board (PCB) 26, two terminal antenna connection ports 35 and 40 for inputting and receiving dual polarized signals, and the isolation card feedback system comprising isolation cards 45 spaced between the radiating elements 10.

The feedback system comprising the isolation cards 45 provides for the electrical coupling of feedback signals to and from the radiating elements 10 in a manner to cancel out undesired leakage signals, thereby facilitating improvement of the antenna's isolation characteristic.

Each crossed dipole radiator 10 in the array comprises two dipole sub-elements 11 and 12 (FIGS. 1 and 5) that provide for the dual polarization characteristic in both the transmit and receive modes. Dipole sub-element 11 of each crossed dipole radiator 10 is linked together to all other like dipole sub-elements 11, and correspondingly, dipole sub-element 12 of each crossed dipole is linked together to all other like dipole sub-elements 12, and connect to the two respective distribution networks 15, 17 to correspond with the dual polarized signal (either transmit or receive) present at antenna ports 35, 40, respectively (FIGS. 1 and 2).

The dual polarized radiating elements 10 are each aligned in a slant (45 degrees) configuration relative to the array (longitudinal axis), so to achieve the best balance in the element pattern symmetry in the presence of the mutual coupling between the elements. Distribution networks 15, 17 each include a beam forming network (BFN) 20, 22 respectively that incorporates a power divider network 25, 27 respectively for facilitating array excitation (FIG. 2).

Figure 3:
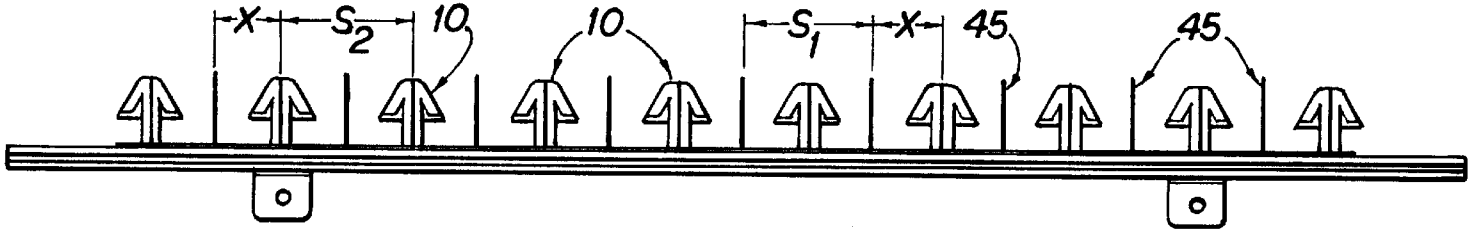
FIG. 3 is an illustration showing a longitudinal side view of the exemplary embodiment shown in FIG. 2 and the relative positions of the isolation cards with the radiating elements of the antenna.

In combination with the radiating elements 10, a conductive surface operative as a radio-electric ground plane 30 (FIG. 2) supports the generation of substantially rotationally symmetric patterns over a wide field of view for the antenna. The ground plane 30 is positioned underneath and adjacent to the distribution networks 15, 17 and over which the radiating elements 10 are coupled relative thereto. FIG. 3 also shows the isolation cards 45 are operatively positioned within the dual polarized antenna system relative to the radiating elements 10 so to achieve the desired amount of coupling between the radiating elements 10 and the feedback elements 55.

Figure 5:
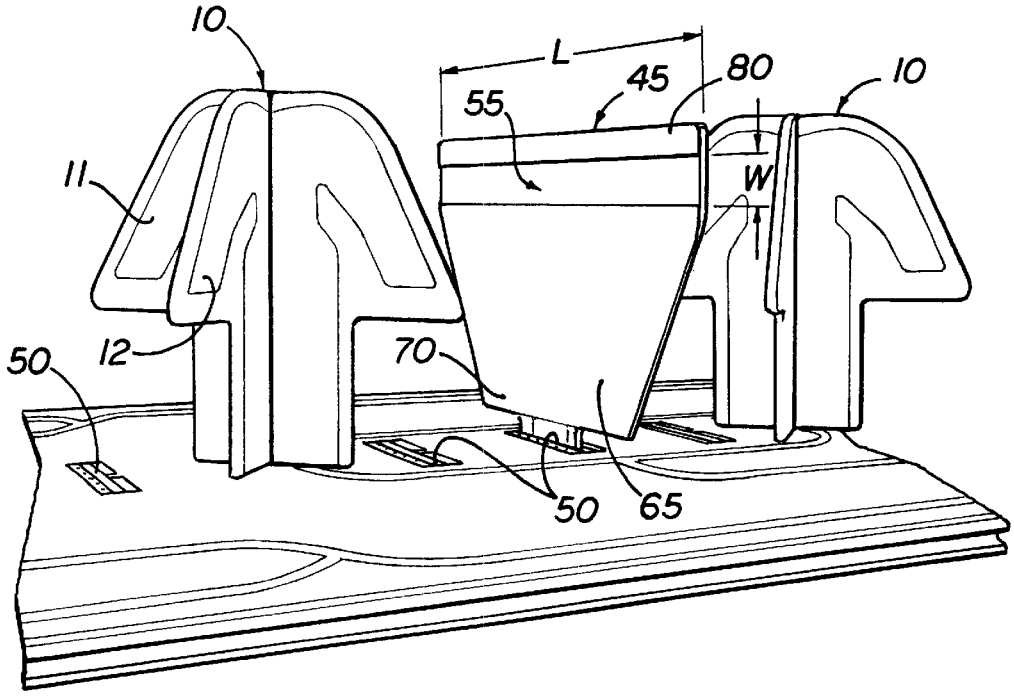
FIG. 5 is an illustration showing an isometric view of the exemplary embodiment shown in FIGS. 2 and 3.

Referring now to FIG. 5, each feedback element 55 can comprise a photo-etched metal strip supported by a planar dielectric support 65 made from printed circuit board material. The feedback element 55 on each isolation card 45 can comprise a single conductive strip. Alternatively, it can comprise spaced-apart, photo-etched conductive strips, with many different spacing configurations, with equal success in achieving the improved port-to-port isolation characteristic for the antenna.

Such feedback elements 55 can provide a high degree of repeatability and reliability in that the manufacturing of such feedback elements 55 can be precisely controlled. For example, the size, shape and location of the feedback elements 55 on the dielectric support can be manufactured by using photo etching and milling processes. Such feedback elements 55 are conducive for high volume production environments while maintaining high quality standards. The manufacturing processes for such feedback elements 55 provide the advantage of small tolerances.

Figure 4:
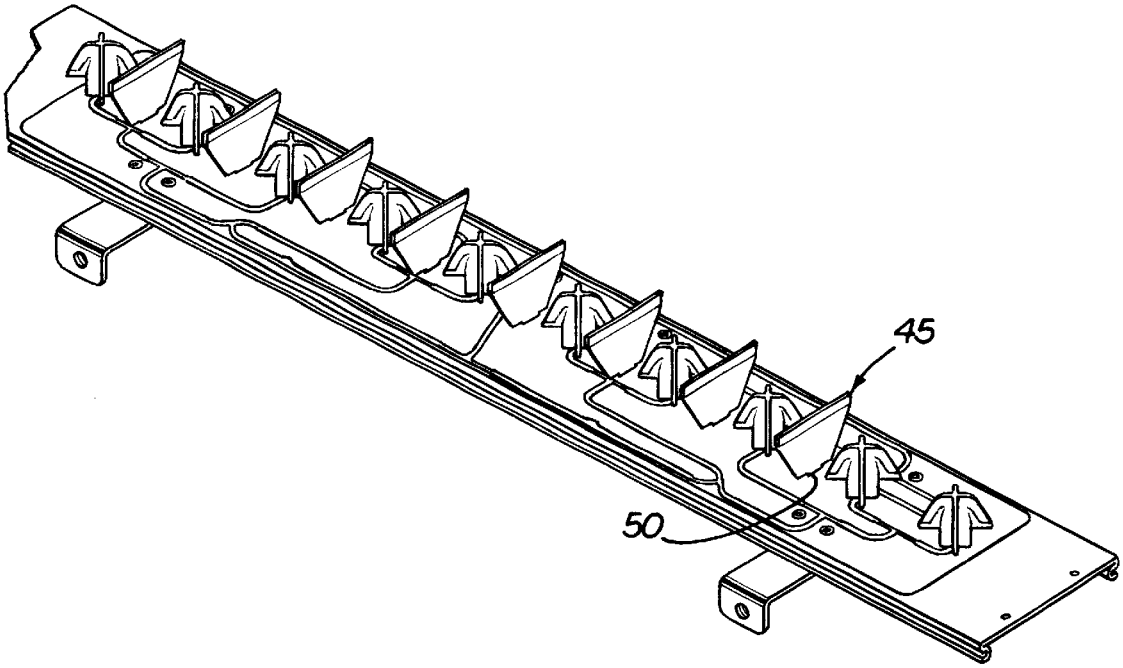
FIG. 4 is an end side view of the antenna shown in FIGS. 2 and 3 depicting the relative dimension of the feedback element and a dipole radiator.

FIGS. 3 and 4 also show that the isolation cards 45 are distributed in a consistent fashion with one card 45 positioned between every two radiating elements 10, aligned along a perpendicular to the center line 13 (FIG. 2) of the antenna 5, and positioned relatively midway between any two adjacent radiators 10. That is, the distance X (FIG. 3) between a respective radiator 10 and an isolation card 45 is maximized such that each isolation card 45 is as far away from an adjacent pair of radiating elements 10 as possible. With such an arrangement, the possibility of the isolation cards 45 distorting the impedance of the radiating elements 10 is substantially eliminated.

Because of the midway positioning of the isolation cards 45, it follows that the relative spacing S1 between respective cards 45 is substantially equal to the spacing S2 between respective radiating elements 10 when the radiating elements 10 are positioned in a uniform manner. In this exemplary embodiment, the spacing S2 between the radiating elements 10 is approximately three-quarters (¾) of the operating wavelength. Accordingly, the corresponding spacing S1 of the isolation cards 45 is also approximately three quarters (¾) of the operating wavelength. However, other spacings can be used based on the coupling desired and variations from the three quarter wavelength used in the preferred embodiment are within the scope of the invention. In other words, uniform and non-uniform spacing between respective isolation cards 45 themselves or spacing between isolation cards 45 and antenna elements 10 can be employed without departing from the scope and spirit of the present invention.

One important feature of the present invention is the high degree of control over the material properties of the feedback element support structure. Each isolation card support structure is typically an insulative material that has electrical and mechanical properties that are amenable to extreme operating environments of antenna arrays. For example, such support structure can be selected to provide appropriate dielectric constants (relative permeability), lost tangent (conductivity) and coefficient of thermal expansion in order to optimize the isolation between respective antenna elements in an antenna array.

Referring back to FIG. 5, the isolation card 45 is made of a dielectric material that forms a planar dielectric support 65 with a narrow bottom end 70 for connecting to the printed circuit board (PCB). The dielectric material of the isolation card 45 can comprise one of many low-loss dielectric materials used in radio circuitry. In the preferred embodiment, it is made from a material known in the art as MC3D (a medium frequency dielectric laminate manufactured by Gill Technologies). MC3D is a relatively low-loss material and is fairly inexpensive. The dielectric constant of MC3D is approximately 3.86. However, the present invention is not limited to this dielectric constant and this particular dielectric material. Other dielectric constants can fall generally within the range of 2.0 to 6.0. The dielectric support used has a dissipation factor of 0.019. However, other low-loss type dielectric materials with different dissipation factors are not beyond the scope of the present invention.

The isolation card 45 used in this exemplary embodiment has a thickness of 31 mils. However, other thicknesses can also be used. The narrow portion 70 is typically a function of the size of the aperture 50 in the printed circuit board. At its opposite end, the isolation card 45 has a wide portion 80 that is typically a function of the length L (FIG. 5) of the feedback element 55. However other shapes, different from that shown in FIG. 5, can be selected depending upon ease of manufacturing as well as efficient and economic use of the dielectric material that forms the isolation card 45. For example, to minimize the amount of dielectric material used, the support could be formed as a "T" shape. The shape should be chosen to maximize mechanical rigidity of the isolation card 45 while minimizing unnecessary excess dielectric material that does not contribute to the card's mechanical rigidity or strength.

The feedback element 55 on the isolation card 45 is positioned near the top thereof and, in the preferred embodiment comprises a conductive strip running parallel to the PCB 26 as illustrated in FIG. 5. The conductive strip can be electro-deposited or rolled copper. In one exemplary embodiment, the conductive strip is photo-etched (by use of photolithography) on the dielectric material. This method is very conducive to high speed, high volume, and precision controlled manufacturing capabilities. The feedback elements 55 may also be attached to the dielectric material of the isolation card 45 by soldering them to metal pads etched onto the isolation card 45, or by using an adhesive.

Figure 6:
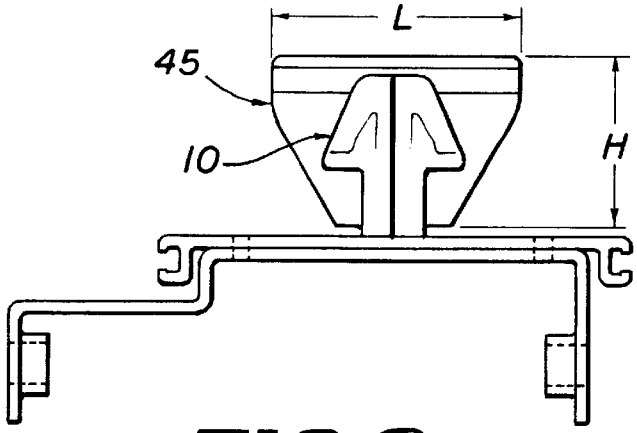
FIG. 6 is a side view of the antenna system shown in FIGS. 2 and 3.

Referring now to FIG. 6, Length L of the conductive strip is three-fifths (3/5) of the operating wavelength. However, the present invention is not limited to this resonant length. The length of the conductive strip can be approximately 0.4 to 0.6 wavelength in this embodiment. As a general rule of thumb, the length of the conductive strip is typically an unequal number of half wavelengths.

The height H of the conductive strip is illustrated in FIG. 6 relative to the antenna's ground plane 30, and is approximately equal to the height of the radiating element 10. That is, the conductive strip can be aligned in a parallel manner with its adjacent radiating elements 10. However, this exemplary height parameter can be changed to optimize the degree of coupling depending upon the particular application at hand.

The width W of the conductive strip (FIG. 5) can be adjusted or tuned to various widths. This width W is typically chosen to provide sufficient operating impedance bandwidth that is similar to that of the radiating elements 10. The resonant length of the conductive strip can vary as the width of the conductive strip is adjusted. In other words, the conductive strip feedback element 55 can be made of various widths and lengths to provide the required resonance effect depending upon the frequencies involved and the specific application at hand. It is further noted that the width directly affects the amount of coupling that can be achieved by each feedback element 55 and, thus, the width (like the length) may vary from one application to another depending on the amount of required coupling.

Connection of the isolation card 45 to the PCB is usually completed with the use of an aperature in the PCB 26 as shown in FIG. 5. Aperture 50 receives the bottom portion 70 of the isolation card 45 to allow the card to be precisely positioned between respective pairs of radiating elements 10.

Figure 7:
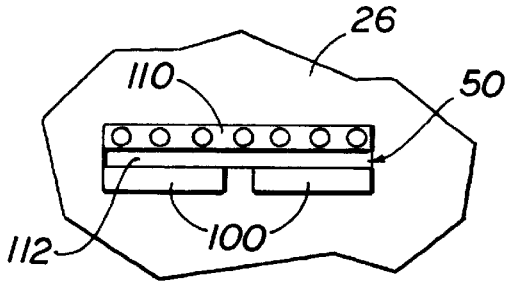
FIG. 7 is a bottom view of a part of the antenna system according to one exemplary embodiment that shows a locating aperture for the support structure of a feedback element.

Referring to FIG. 7, a connector 110 is positioned in the aperture and penetrates through the PCB and contains openings 112 for making electrical connections to the ground plane 30, if desired. Apertures 50 in combination with the connectors 110 provide for rapid and consistent placement of the isolation cards 45 between the radiating elements 10. Additional mounting options are possible using the apertures to increase the mechanical rigidity of the isolation cards 45 such as, for example, by adding "kick stands" to the support structure.

Further details of the connector forming the aperture 50 are illustrated in FIG. 7 showing a bottom view of the aperture connector. Connector mechanisms 100, such as solder pads, are placed on one side of the connector to give additional mechanical stability to the isolation card 45. In this exemplary embodiment, the connector mechanisms 100 do not provide any electric purpose. On the opposing side of the connector there are additional connecting mechanisms 110 that comprise the electrical connections via plated thru-holes.

Figure 8:
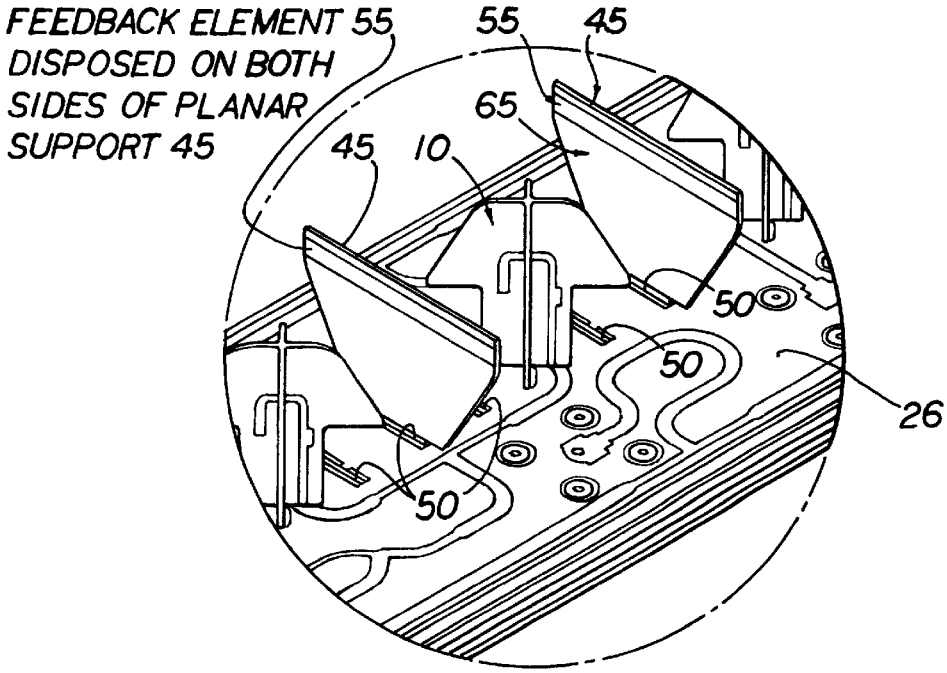
FIG. 8 is an isometric view of an enlarged part of the antenna system according to another exemplary embodiment that shows multiple slots for the location of the support structures of the feedback elements.

FIG. 8 illustrates an alternate embodiment showing additional apertures 50 with connecting mechanisms 110 that can be incorporated into the PCB 26 for alternative antenna configurations utilizing the isolation cards 45 with the same type of feed network. The additional slots 50 allow for precise positioning of the isolation cards 45. The apertures 50 can be formed by known milling processes.

Turning now to the functioning of the isolation card 45, the isolation card 45 is set at a position relative to adjacent dipoles to generate feedback signals via the resonating feedback elements 55 on each isolation card 45 to cancel leakage signals present at antenna connection ports 35, 40. A feedback signal can be generated by a feedback element 55 resonating in response to the first polarized signal at the dipole sub-element 11. This feedback signal can then be coupled back into the second polarized signal at sub-element 12 on the same dipole radiator. The feedback signal can cancel the leakage signal because the feedback signal is identical in frequency and is 180 degrees out-of-phase from the source signal.

Similarly, another feedback signal can be generated by a feedback element 55 resonating in response to a second polarized signal produced at the dipole sub-element 12. This feedback signal can be coupled back into the first polarized signal at sub-element 11.

To obtain a complete cancellation of a leakage signal, the feedback signal usually must have an amplitude equal to the amplitude of the respective leakage signal. The exact positioning of the feedback elements 55 can be empirically determined and is often a function of the feedback elements 55 receiving electromagnetic signals of a certain amplitude or strength from those transmitted (or received) by the radiating elements 10.

Empirical measurements can be conducted to determine the proper number of isolation cards 45 and the proper orientation of each relative to the radiators 10, to obtain a feedback signal having the appropriate amplitude so as to achieve the complete cancellation of a leakage signal at either of the antenna's two connection ports. By "tuning" the antenna with the appropriate amount of coupling, a feedback signal having the correct amplitude will be produced which, in turn, will result in the desired amount of isolation being achieved within the antenna system.

This tuning is a function of the feedback element 55 design on the isolation card 45 and the height and spacing of the card relative to adjacent radiators. Ultimately, the actual spacing and configuration of the feedback elements 55 will depend upon the particular application at hand to generate a strength or amplitude of feedback signal needed to cancel out any leakage signals at ports 35, 40.

Each feedback signal contributes to the generation of an aggregate feedback signal having the desired amplitude and phase characteristics. Thus, when the two feedback signals sum with the leakage signal at either antenna connector ports 35, 40, the leakage signals are canceled by the 180 degree phase difference of the feedback signals.

Figure 9:
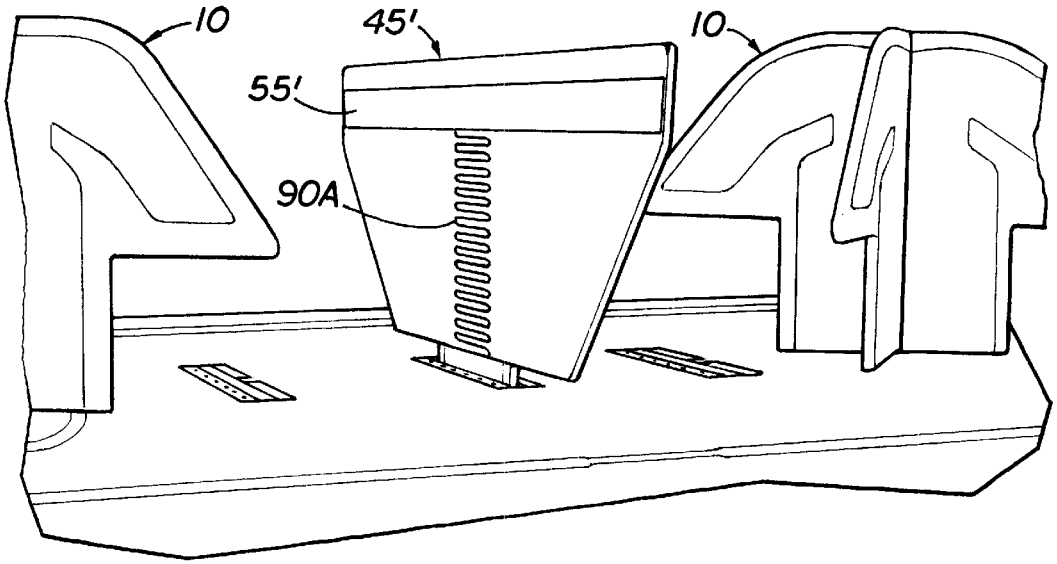
FIG. 9 is another isometric view of an antenna illustrating the positioning of a feedback element provided with the first exemplary grounding element.

An alternate embodiment of the isolation card 45' is illustrated in FIG. 9, where a different feedback element 55' includes a grounding element 90A. The grounding element 90A can be formed as a high impedance meandering line that gives a direct current (DC) connection between feedback element 55' and the ground plane 30.

This grounding element 90A is basically a wire with very high inductance, and in this embodiment it has a width of approximately 10 mils. The width is typically chosen so that it is not difficult to etch on the dielectric support 65. The thickness of the grounding element 90A as well as the conductive strip 60 is approximately 1.5 mils. However, other thickness of this material may be used and still remain within the scope of the invention.

The function of grounding element 90A is to drain any charges that may build up on the conductive strip 60 during operation of the antenna system. This insures that the conductive strip is at the same voltage potential as the ground plane 30 in order to reduce the possibility of the conductive strip being charged and attracting lightning. Therefore, the grounding element 90A is designed to only transmit, short to ground, DC currents and not RF currents.

Figure 10:
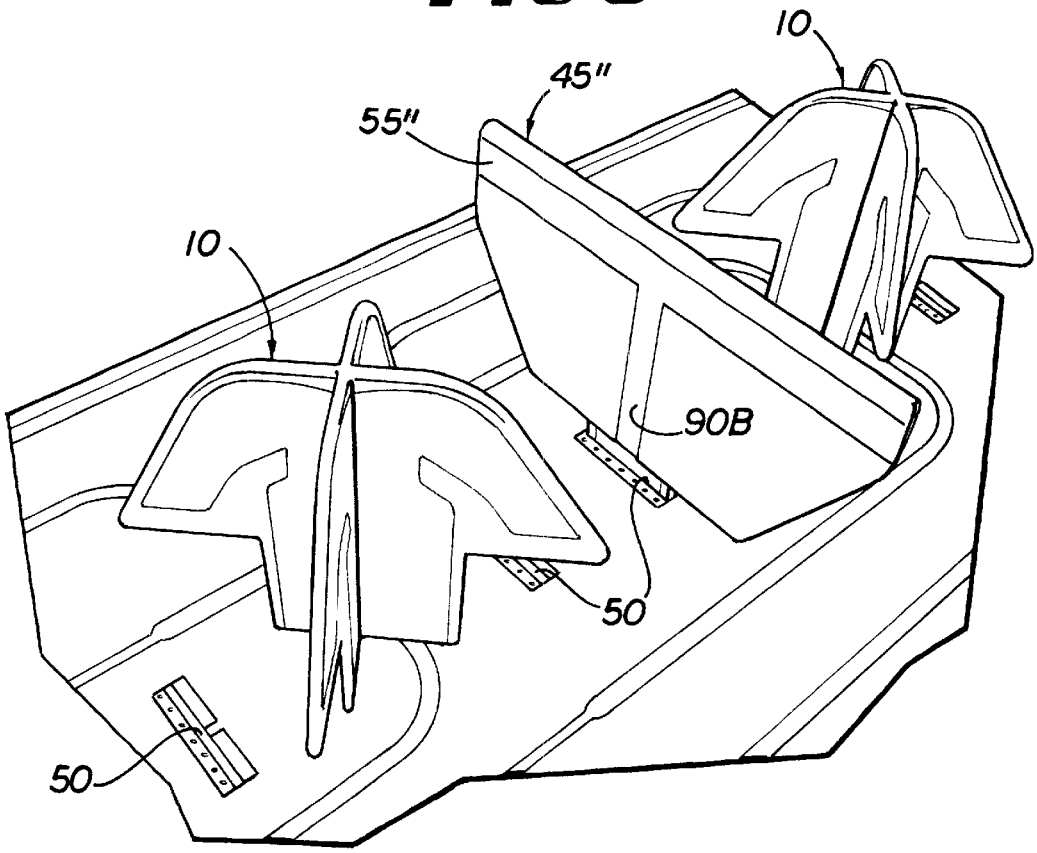
FIG. 10 is another isometric view of an antenna illustrating the positioning of feedback element provided with the second exemplary type of grounding element.

As a third embodiment, FIG. 10 illustrates another type feedback element 55'''. This element 55''' comprises a conductive strip grounding element 90B with a design that can more readily support induced currents as a result of unbalanced dipole balun radiation. This grounding element design gives greater protection against lightning, and it also has more of an RF impact than the meandering line type 90A in FIG. 9.

In each of the embodiments, the feedback element 55 may be disposed on both sides of the isolation card 45, as depicted by the functional block in FIG. 8. The feedback element 55 may be left floating, or grounded to the network ground plane 30 through plated thru-holes as illustrated in FIG. 10.

In summary, the isolation card 45 employs materials with well-defined electrical parameters that remain constant in typical antenna array operating environments, and allows use of feedback elements 55 that are conducive to high speed, high volume, and precision-controlled manufacturing capabilities. Manufacturing of the isolation card 45, and particularly the feedback element 55 on the card, are highly repeatable and their designs allow for easy control and design flexibility in the shape of the feedback signal path by microstrip or other conductive path design created on the dielectric support with a high precision that is possible with etching processes.

The feedback elements 55 are typically used on base station, dual-pole slant +/−45 degree antennas for wireless communications operating at frequency ranges of 2.4 Gigahertz (GHz). They typically provide a port-to-port isolation greater than 30 decibels. It is noted that while the isolation characteristics of the radiating elements 10 improved by one or two decibels compared to the conventional feedback elements that employ conductors on Styrofoam blocks, the far field antenna radiation patterns were also cleaner or more well-behaved than those produced by feedback elements disposed on Styrofoam blocks. It is an added benefit that the feedback elements 55, while substantially reducing near field cross coupling to improve the isolation in a dual polarized antenna, they also improve the antenna's far field radiation characteristics.

The location of the isolation card 45 can be precisely controlled by apertures 50 that are disposed in the PCB 26. The dielectric support 65 for each feedback element 45 may or may not include "kick stands" for additional mechanical support. Additional apertures 50 can be incorporated into the printed circuit board material 26 for alternative antenna configurations using the same beam forming network.

Figure 11:
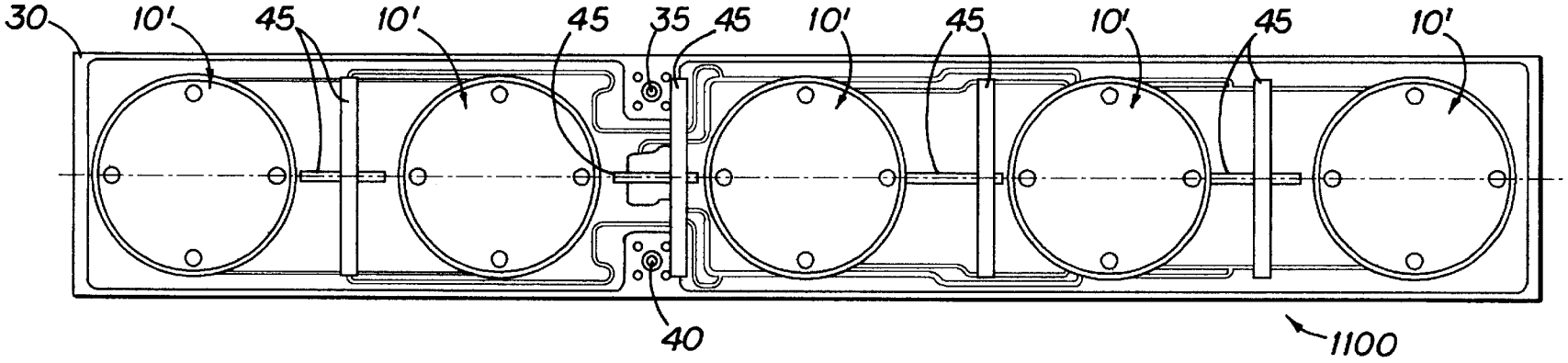
FIG. 11 is an illustration showing an elevational view of the construction of alternate exemplary embodiment of the present invention where isolation cards are positioned between multiple band radiators.

Referring now to FIG. 11, this figure illustrates another exemplary operating environment for the inventive isolation card 45. In this exemplary embodiment, isolation cards 45 are positioned between multiple band radiators 10' of antenna system 1100. Further, in this exemplary embodiment, multiple isolation cards 45 can be stacked upon one another in order to provide enhanced leakage signal reduction and increased isolation between ports of the antenna system. In this particular and exemplary embodiment, one set of isolation cards 45 is oriented in a parallel manner with a central axis 13 while another set of isolation cards 45 is perpendicularly oriented with the central axis 13.

The radiators 10' can comprise patch antenna elements that can operate in multiple frequency bands. However, as noted above the present invention is not limited to one type of antenna element. Therefore, other types of radiating elements are not beyond the scope of the present invention. Other radiating antenna elements include, but are not limited to, monopole, microstrip, slot, and other like radiators. With the isolation cards 45, RF signals between multiple frequency bands can be isolated from one another similar to the dual polarization antenna system illustrated in FIG. 2.

Figure 12:
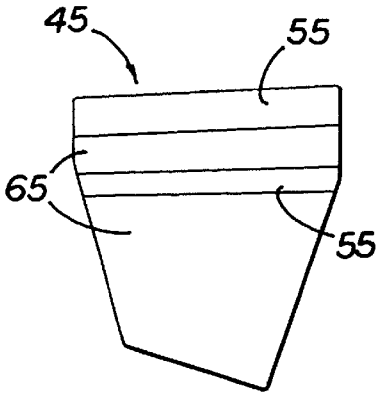
FIG. 12 is another isometric view illustrating multiple feedback elements provided on an isolation card.

Referring now to FIG. 12, this figure illustrates another isometric view of multiple feedback elements 55 provided on an isolation card 45. Specifically, an isolation card 55 can further comprise multiple feedback elements 55 that can be placed proximate to one another to provide additional feedback signals.

Figure 13:
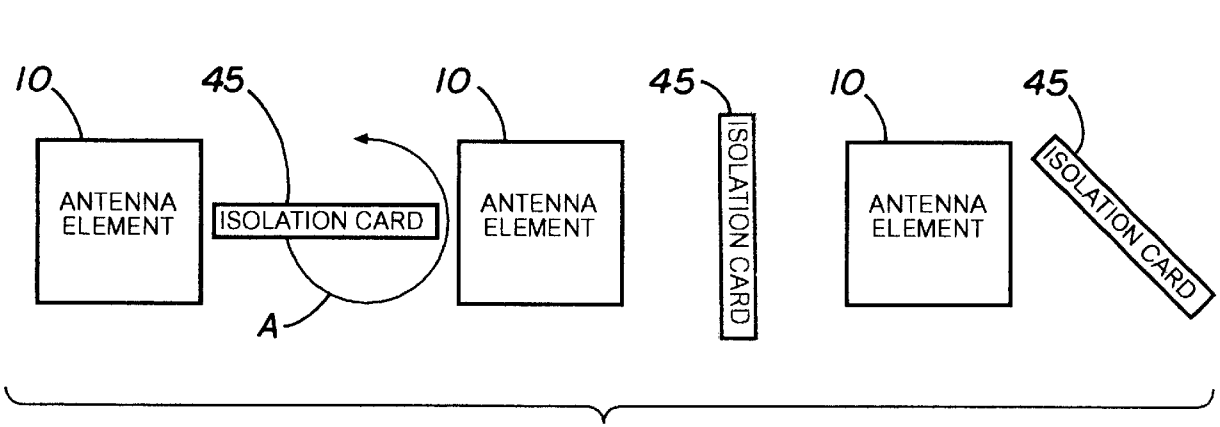
FIG. 13 is a functional block diagram illustrating various orientations of isolation cards relative to radiating antenna elements.

Referring to FIG. 13, this Figure illlustrates a top view or an elevational view of the antenna elements 10 and isolation cards 45. The arrow labeled "A" indicates that each isolation card 45 can be rotated to a desired angle that maximizes the cancellation of any leakage signals that may be sent to a port. A group of antenna elements 10 could have RF Isolation cards 45 oriented at various angles to maximize cancellation of any leakage signals that are generated between antenna elements of an element array.

Although the embodiments of the present invention have been described with particularity to several different feedback mechanisms in conjunction with dual polarized radiator antennas and multiple band radiator antennas, the present invention can be equally applied to other types of antennas.

While the invention has been described in its exemplary forms, it should be understood that the present disclosure has been made only by way of example and that numerous changes in the details of construction and the combination and arrangement of parts may be resorted to without departing from the spirit and scope of the invention. Accordingly, the scope of the present invention is defined by the appended claims rather than the foregoing description.

What is claimed is:

1. An antenna system comprising:

a plurality of antenna elements;

a feed network, coupled to each of the antenna elements, for communicating the electromagnetic signals from and to each of the antenna elements; and a feedback system coupled relative to the feed network and the antenna elements for generating a feedback signal to at least one of the antenna elements, the feedback system comprising at least one planar conductive strip disposed on a side of a planar dielectric support, the planar conductive strip having a length, width, and thickness wherein the length and width are larger than the thickness, the conductive strip generating the feedback signal in response to receiving the electromagnetic signals transmitted by the antenna elements, the feedback signal operative to cancel a leakage signal present at the feed network and thereby increase the port to port isolation of the antenna system.

2. The antenna system of claim 1, wherein the antenna elements comprise dual polarized radiators, the feedback system increasing the isolation between polarizations whereby leakage signals present at ports of the feed network are substantially reduced or eliminated.

3. The antenna system of claim 2, wherein the dual polarized radiators comprise crossed dipoles.

4. The antenna system of claim 1, wherein the antenna elements comprise radiators operating in multiple frequency bands, the feedback system increasing isolation between frequency bands whereby leakage signals present at ports of the feed network are substantially reduced.

5. The antenna system of claim 4, wherein the radiators operating in multiple frequency bands comprise patch radiators.

6. The antenna system of claim 1, wherein the planar conductive strip is a first planar conductive strip disposed and the side of the planar dielectric support is a first side, the feedback system further comprising a second planar conductive strip disposed on a second side of the planar dielectric support.

7. The antenna system of claim 1, further comprising a ground plane and a printed circuit board, the antenna elements being connected to the printed circuit board, the printed circuit board and the ground plane further comprising a slot for receiving an end portion of the planar dielectric support.

8. The antenna system of claim 7, further comprising a plurality of slots disposed in the ground plane and printed circuit board, the slots being positioned between respective pairs of antenna elements.

9. The antenna system of claim 1, wherein the planar conductive strip comprises electro-deposited or rolled copper.

10. The antenna system of claim 1, wherein the planar conductive strip is photo-etched on the planar dielectric support.

11. The antenna system of claim 1, wherein the length of the planar conductive strip is approximately three-fifths of an operating wavelength of the antenna elements.

12. The antenna system of claim 1, wherein the length of the planar conductive strip is approximately between 0.4 to 0.6 of an operating wavelength of the antenna elements.

13. The antenna system of claim 1, wherein the length of the planar conductive strip is approximately an unequal number of half wavelengths.

14. The antenna system of claim 1, wherein the planar conductive strip is disposed at a height above a ground plane of the antenna system that is substantially equal to a height of an antenna element.

15. The antenna system of claim 1, wherein the planar dielectric support and the planar conductive strip are disposed at an angle relative to one of the antenna elements.

16. The antenna system of claim 1, further comprising a plurality of planar dielectric supports having respective planar conductive strips, the planar dielectric supports having non-uniform spacing between each other.

17. The antenna system of claim 1, further comprising a plurality of planar dielectric supports having respective planar conductive strips, the planar dielectric supports being positioned between respective pairs of antenna elements and being oriented at various rotational angles relative to each other.

18. The antenna system of claim 1, further comprising a plurality of planar dielectric supports having respective planar conductive strips, the planar dielectric supports having substantially uniform spacing between each other, wherein a planar dielectric support is positioned between a respective pair of antenna elements.

19. The antenna system of claim 18, wherein the uniform spacing comprises a length of approximately three quarters of an operating wavelength.

20. The antenna system of claim 1, wherein the planar conductive strip is a first planar conductive strip, the feedback system further comprising a second planar conductive strip disposed on the side of the planar dielectric support with the first planar conductive strip.

21. The antenna system of claim 1, further comprising a plurality of stacked planar dielectric supports having respective planar conductive strips, wherein each stacked planar dielectric support comprises at least two planar dielectric supports positioned at an angle relative to each other.

22. The antenna system of claim 1, wherein the planar dielectric support comprises a dielectric material having a dielectric constant of 3.86.

23. The antenna system of claim 1, wherein the planar dielectric support comprises a dielectric material having a dielectric constant within a range between approximately 2.0 and 6.0.

24. The antenna system of claim 1, wherein the planar dielectric support comprises a dielectric material having a dissipation factor of approximately 0.019.

25. The antenna system of claim 1, further comprising a ground plane and a grounding element that provides a dc connection between the ground plane and the planar conductive strip.

26. The antenna system of claim 25, wherein the grounding element comprises one of a high impedance meandering line and a conductive strip.

27. A method for increasing isolation between ports of an antenna system, comprising the steps of:

coupling a first port to a first feed network;

coupling the first feed network to a first set of antenna elements;

coupling a second port to a second feed network;

coupling the second feed network to a second set of antenna elements;

electromagnetically coupling a feedback system to the first and second feed networks and to the first set and second set of antenna elements, the feedback system comprising at least one planar conductive strip disposed on a side of a planar dielectric support;

generating a feedback signal in response to receiving the electromagnetic signals transmitted by the antenna elements; and canceling a leakage signal at the feed network with the feedback signal.

28. The method of claim 27, wherein the step of coupling the first feed network to a first set of antenna elements further comprises coupling the first feed network to a first set of antenna elements operating at a first polarization and wherein the step of coupling the second feed network to a second set of antenna elements further comprises coupling the second feed network to a second set of antenna elements operating at a second polarization.

29. The method of claim 27, wherein the step of coupling the first feed network to a first set of antenna elements further comprises coupling the first feed network to a first set of antenna elements operating at a first frequency range and wherein the step of coupling the second feed network to a second set of antenna elements further comprises coupling the second feed network to a second set of antenna elements operating at a second frequency range.

30. The method of claim 27, further comprising the step of forming the planar conductive strip with electro-deposited or rolled copper.

31. The method of claim 27, further comprising the step of photo-etching the planar conductive strip on the planar dielectric support.

32. The method of claim 27, further comprising the step of sizing the planar conductive strip to a length of approximately three-fifths of an operating wavelength of the antenna elements.

* * * * *